US009664395B2

(12) United States Patent
Livchak et al.

(10) Patent No.: US 9,664,395 B2
(45) Date of Patent: May 30, 2017

(54) LOW PROFILE EXHAUST HOOD

(75) Inventors: Andrey V. Livchak, Bowling Green, KY (US); Derek W. Schrock, Bowling Green, KY (US); Rick A. Bagwell, Scottsville, KY (US); Darrin W. Beardslee, Bowling Green, KY (US)

(73) Assignee: OY HALTON GROUP, LTD., Vantaa (FI)

( * ) Notice: Subject to any disclaimer, the term of this patent is extended or adjusted under 35 U.S.C. 154(b) by 809 days.

(21) Appl. No.: 13/607,706

(22) Filed: Sep. 8, 2012

(65) Prior Publication Data

US 2013/0037017 A1 Feb. 14, 2013

Related U.S. Application Data

(63) Continuation of application No. 11/722,378, filed as application No. PCT/US2006/000579 on Jan. 6, 2006.

(60) Provisional application No. 60/593,331, filed on Jan. 6, 2005.

(51) Int. Cl.
*F24C 15/20* (2006.01)
*B08B 15/02* (2006.01)

(52) U.S. Cl.
CPC ..... *F24C 15/20* (2013.01); *F24C 15/2035* (2013.01); *B08B 15/02* (2013.01)

(58) Field of Classification Search
CPC ..... F24C 15/2035; F24C 15/20
USPC ..... 454/67; 126/299 R
See application file for complete search history.

(56) References Cited

U.S. PATENT DOCUMENTS

| | | | |
|---|---|---|---|
| 2,499,301 A | 2/1950 | Dorfan | |
| 2,868,108 A | 1/1959 | Petersen | |
| 2,886,124 A | 5/1959 | Scharmer | |
| 3,125,869 A | 3/1964 | Winton | |

(Continued)

FOREIGN PATENT DOCUMENTS

| | | | |
|---|---|---|---|
| DE | 10209693 A1 * | 9/2003 | ..... B08B 15/00 |
| DE | 102005048987 A1 * | 4/2007 | |

(Continued)

OTHER PUBLICATIONS

Written Opinion of the International Search Authority for International Application No. PCT/US06/00579.

(Continued)

*Primary Examiner* — Alissa Tompkins
*Assistant Examiner* — Frances F Hamilton
(74) *Attorney, Agent, or Firm* — Potomac Law Group, PLLC; Mark Catan

(57) ABSTRACT

An exhaust hood includes a top wall extending in a horizontal direction, a convexly curved front wall extending in a vertical direction from the top wall. The hood also includes a filter support plate that holds a grease filter under the top wall and horizontally spaced from the front wall. The support plate is angled such that a bottom edge of the plate is farther in the horizontal direction from the front wall than a top edge of the plate proximal to the top wall. Surfaces of the top wall, the front wall, the filter support panel, and of a baffle under the support plate bound a chamber through which fumes flow to the grease filter. A free end of the front wall can be closer to the top wall than a portion of the front wall between the first end and the free end of the front wall.

9 Claims, 7 Drawing Sheets

(56) References Cited

U.S. PATENT DOCUMENTS

| | | | | | |
|---|---|---|---|---|---|
| 3,841,062 | A | | 10/1974 | Molitor et al. | |
| 3,941,039 | A | | 3/1976 | Kinney | |
| 3,943,836 | A | | 3/1976 | Kuechler | |
| 4,011,802 | A | * | 3/1977 | Molitor et al. | 126/299 R |
| 4,043,319 | A | * | 8/1977 | Jensen | 126/299 D |
| 4,066,064 | A | | 1/1978 | Vandas | |
| 4,211,154 | A | * | 7/1980 | Eakes | 454/66 |
| 4,556,046 | A | | 12/1985 | Riffel et al. | |
| 4,738,243 | A | | 4/1988 | Welsh et al. | |
| 4,738,244 | A | * | 4/1988 | Welsh | 126/299 R |
| 4,822,385 | A | * | 4/1989 | Strege et al. | 96/334 |
| 4,902,316 | A | | 2/1990 | Giles, Sr. et al. | |
| 4,903,894 | A | | 2/1990 | Pellinen et al. | |
| 5,042,456 | A | | 8/1991 | Cote | |
| 5,251,608 | A | | 10/1993 | Cote | |
| 5,285,771 | A | * | 2/1994 | Griffes | 126/299 D |
| 5,320,088 | A | * | 6/1994 | Nester | 126/299 D |
| 5,421,320 | A | | 6/1995 | Brown | |
| 5,467,761 | A | * | 11/1995 | Kuechler | 126/299 D |
| 5,673,681 | A | | 10/1997 | Neitzel et al. | |
| 5,713,346 | A | | 2/1998 | Kuechler | |
| 5,755,214 | A | * | 5/1998 | Lai | 126/299 E |
| 6,125,841 | A | | 10/2000 | Boudreault | |
| 6,173,710 | B1 | | 1/2001 | Gibson et al. | |
| 6,336,451 | B1 | * | 1/2002 | Rohl-Hager et al. | 126/299 D |
| 6,349,716 | B1 | * | 2/2002 | Morton | 126/299 R |
| 6,443,144 | B1 | * | 9/2002 | Van Niekerk | 126/299 D |
| 6,658,796 | B1 | | 12/2003 | Higgins | |
| 6,782,885 | B1 | * | 8/2004 | Chiang et al. | 126/299 R |
| 6,851,421 | B2 | | 2/2005 | Livchak et al. | |
| 6,869,468 | B2 | | 3/2005 | Gibson | |
| 6,878,195 | B2 | | 4/2005 | Gibson | |
| 6,899,095 | B2 | | 5/2005 | Livchak et al. | |
| 7,147,168 | B1 | | 12/2006 | Bagwell et al. | |
| 7,364,094 | B2 | | 4/2008 | Bagwell et al. | |
| 7,470,298 | B2 | * | 12/2008 | Berling et al. | 55/320 |
| 8,505,530 | B2 | * | 8/2013 | Robison et al. | 126/299 R |
| 2002/0134371 | A1 | | 9/2002 | Ward et al. | |
| 2002/0174632 | A1 | * | 11/2002 | Chiang et al. | 55/418 |
| 2003/0146082 | A1 | | 8/2003 | Gibson et al. | |
| 2004/0035411 | A1 | | 2/2004 | Livchak et al. | |
| 2004/0149278 | A1 | * | 8/2004 | Lin | 126/299 R |
| 2004/0194778 | A1 | * | 10/2004 | Yeung | 126/299 R |
| 2004/0211321 | A1 | | 10/2004 | Gibson | |
| 2005/0022922 | A1 | | 2/2005 | Banasky | |
| 2005/0279845 | A1 | | 12/2005 | Bagwell et al. | |
| 2006/0032492 | A1 | | 2/2006 | Bagwell et al. | |
| 2006/0219235 | A1 | | 10/2006 | Bagwell et al. | |
| 2007/0015449 | A1 | | 1/2007 | Livchak | |
| 2007/0023349 | A1 | | 2/2007 | Kyllonen et al. | |
| 2007/0068509 | A1 | | 3/2007 | Bagwell et al. | |
| 2007/0272230 | A9 | | 11/2007 | Meredith et al. | |
| 2008/0045132 | A1 | | 2/2008 | Livchak et al. | |

FOREIGN PATENT DOCUMENTS

| | | | | |
|---|---|---|---|---|
| DE | 10209693 | B4 * | 4/2011 | |
| EP | 2270638 | | 3/1994 | |
| EP | 0874199 | | 10/1998 | |
| GB | 2270638 | A * | 3/1994 | F24C 15/20 |
| WO | WO 97/48479 | | 12/1997 | |
| WO | WO 01/51857 | | 7/2001 | |
| WO | WO 02/14728 | | 2/2002 | |
| WO | WO 02/14746 | | 2/2002 | |
| WO | WO 2005/019736 | | 3/2005 | |
| WO | WO 2005/114059 | | 12/2005 | |
| WO | WO 2006/002190 | | 1/2006 | |
| WO | WO 2006/012628 | | 2/2006 | |
| WO | WO 2006/074420 | | 7/2006 | |
| WO | WO 2006/074425 | | 7/2006 | |
| WO | WO 2007/121461 | | 10/2007 | |

OTHER PUBLICATIONS

Office Action issued Feb. 17, 2012, in Canadian Application No. 2,593,242.

* cited by examiner

LOW PROFILE EXHAUST HOOD

CROSS-REFERENCE TO RELATED APPLICATIONS

This application is a continuation of U.S. application Ser. No. 11/722,378, filed Jun. 21, 2007 (371(c) date of Mar. 13, 2008), which is a national stage entry of International Application No. PCT/US06/00579, filed Jan. 6, 2006, which claims the benefit of U.S. Provisional Application No. 60/593,331, filed Jan. 6, 2005, all of which are hereby incorporated by reference herein in their entireties.

BACKGROUND AND PRIOR ART

Basic exhaust hoods use an exhaust blower to create a negative pressure zone to draw effluent-laden air directly away from the pollutant source. In kitchen hoods, the exhaust blower generally draws pollutants, including room-air, through a filter and out of the kitchen through a duct system. An exhaust blower, e.g., a variable speed fan, contained within the exhaust hood is used to remove the effluent from the room and is typically positioned on the suction side of a filter disposed between the pollutant source and the blower. Depending on the rate by which the effluent is created and the buildup of effluent near the pollutant source, the speed of exhaust blower may be manually set to minimize the flow rate at the lowest point which achieves capture and containment.

Hoods are intended to act as buffers which match the flow of fumes, which varies, to the constant rate of the exhaust system. But basic hoods and exhaust systems are limited in their abilities to buffer flow. The exhaust rate required to achieve full capture and containment is governed by the highest transient load pulses that occur. This requires the exhaust rate to be higher than the average volume of effluent (which is inevitably mixed with entrained air). Ideally the oversupply of exhaust should be minimized to avoid wasting energy. Hoods work by temporarily capturing bursts of effluent, which rise into the hood due by thermal convection and then, giving the moderate average exhaust rate time to catch up.

One problem with the buffer model is that the external environment may displace fumes and thereby add an excess burden of ambient air into the exhaust stream. This results in fumes being injected into the occupied space surrounding the hood. These transients are an on-going problem for hood design and installation. all the effluent by buffering the and containment by providing a buffer zone above the pollutant source where buoyancy-driven momentum transients can be dissipated before pollutants are extracted. By managing transients in this way, the effective capture zone of an exhaust supply can be increased.

U.S. Pat. No. 4,066,064 shows a backshelf hood with an exhaust intake located at a position that is displaced from a back end thereof. A short sloping portion rises and extends at a shallow angle toward the inlet from the back end of the hood recess.

U.S. Pat. No. 3,941,039 shows a backshelf hood with side skirts and sloping wall from a rear part of the hood to an inlet located near the middle of the hood. The front of the hood as a horizontal portion (baffle) that extends between about 15 percent and about 20 percent of the front to back dimension of the hood. This part is claimed to direct air in a space above the baffle toward the exhaust inlet and to direct air that is drawn from the ambient space in a horizontal direction thereby encouraging rising fumes to be deflected toward the exhaust inlet.

BRIEF DESCRIPTION ON THE DRAWINGS

DETAILED DESCRIPTION OF THE EMBODIMENTS

An eyebrow-type exhaust hood (also called a cap or vent cowl-type hood) may be used above a door or opening such as a pizza, conveyor oven, bakery oven, broiler, steamer. This type of hood overhangs an access opening for the oven or similar equipment and captures thermal plumes that flow upwardly from the access opening. The capture zone is generally at least as wide as the opening. The depth may vary with some designs being shallower than the face of the appliance. Such hoods may be mounted directly on the appliance. Conveyor ovens can project forward of the oven mouth such that the hood may or may not overhang the source of effluent. This type of hood may also be used for conveyor washers, sintering ovens, and other sources of hot effluent.

Figure 1:
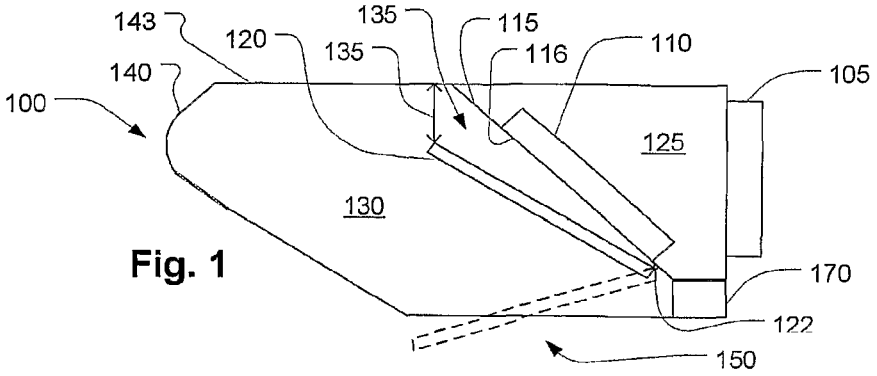
FIG. 1 shows a low profile exhaust hood in partial section view.
Figure 2:
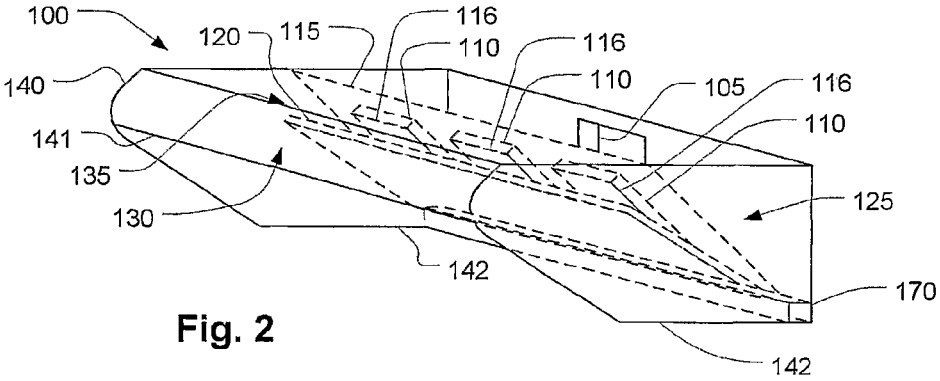
FIG. 2 shows the exhaust hood of FIG. 1 in perspective view.

Referring to FIGS. 1 and 2, an eyebrow hood 100 is shown in cross-section. The hood 100 has a recess 130 defined by sidewalls 142 and a top 140 which covers up to a forward edge 141 thereof. A back of the recess 130 is defined by a forward filter support plate 115 with openings 116 to permit the flow of exhaust effluent into a plenum 125 and supports (the supports are not shown) to support filter cartridges 110 in the openings 116. A baffle plate 120 is connected to the filter support plate 115 by a hinge 122. The hinge 122 allows the baffle plate 120 to be dropped down to the position indicated at 122 to allow the filter cartridges 116 to be removed and installed.

A grease trough 170 collects grease from the filter cartridges 110. The angle of the baffle plate 120 with respect to the filter support plate 115 defines a flow transition 135 leading to the faces of the filter cartridges 110. The position of the baffle plate 120 also defines a slot 135, indicated by the double arrow, through which the effluent stream is drawn by an exhaust system (not shown) connected to the plenum 125 by an exhaust collar 105. The baffle plate 120 also defines a sloping rear planar boundary of the recess 130.

Figure 3:
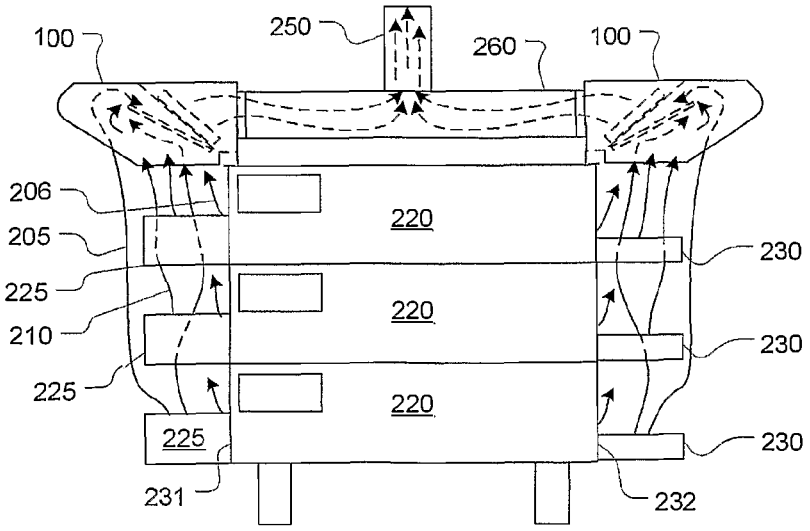
FIG. 3 shows the exhaust hood of FIGS. 1 and 2 in operative association with a stack of conveyor ovens.

Referring now also to FIG. 3, the eyebrow hood 100 is shown mounted to a stack of conveyor ovens 220. Each conveyor oven 220 has inlet and outlet conveyor terminals 225 and 230 which extend beyond respective oven mouths (not visible in the side view) located at the ends 231 and 232 of the ovens 220.

Hot gasses escape from the ends 231 and 232 as well as from material carried on the conveyor terminals 225 and 230. The latter may be open to the flow of gasses allowing plumes, indicated by arrows 210, to rise through the conveyor terminals. Some plumes, such as indicated at 205, may flow around the conveyor terminals 225 and 230. Plumes rising close to the ends 231 and 232 tend to stay close to the ovens 220 due to the. Coanda effect (or wall flow) so that some of the fumes will tend to flow along the baffle plate 120 until sucked into the slot 135.

Plumes rising further away from the ovens 220 will tend to be captured in a suction zone (not indicated separately) around the slot 135. The forward edge 141, which drops downwardly, defines a shallow canopy that helps to buffer and capture flow that is further away from the ovens 220. A common exhaust duct 260 connects the collars 105 of the two eyebrow hoods 100 and leads them to a further common duct 250 that is connected to an exhaust fan (not shown).

By locating the slot 135 in a position remote from the walls 231 and 232 of the ovens 220, a suction zone is defined remote from the ovens 220 to capture fume plumes, such as 205, which rise remote from the ovens 220. Additionally, the baffle plate 120 provides an inclined, partially vertical surface along which plumes closer to the ovens 220, such as 206, may cling and thereby be guided to the slot 135. This configuration allows filters to be located conveniently close to the exhaust collar 105 at a rear end of the eyebrow hood 100. The remotely located suction zone allows the reach of the hood 100 to be extended and its capture efficiency is equivalent to a larger conventional hood with a deeper and more extended canopy.

Figure 4:
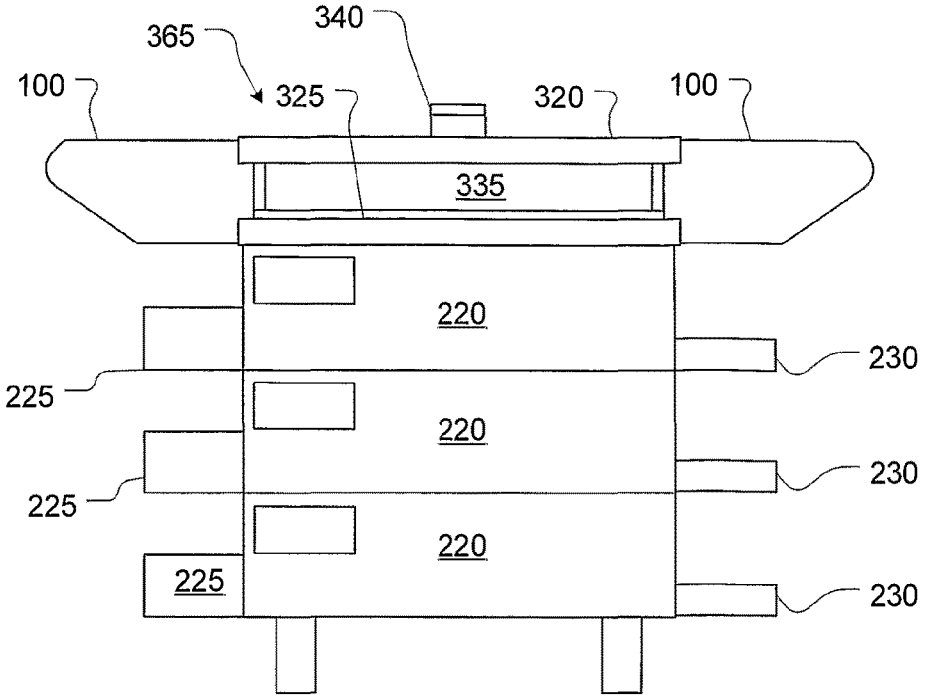
FIG. 4 illustrates a modular structure for mounting the foregoing embodiments of hoods on a stack of conveyor ovens.

Referring now to FIG. 4, a configuration similar to that of FIG. 3 is shown. A bracing structure 365 of angle brackets 320 and 325 supports the eyebrow hoods 100. The bracing structure 365 allows the hoods 100 to rest on top of the ovens 220 and be connected to them. A common duct 335 may be combined with the bracing structure 365 to form a unitary device for mounting the hoods 100. This unitary device may be conveniently disconnected from a building's exhaust system and moved with the ovens 220 rather than installed and left as part of the building's permanent facilities.

Figure 5:
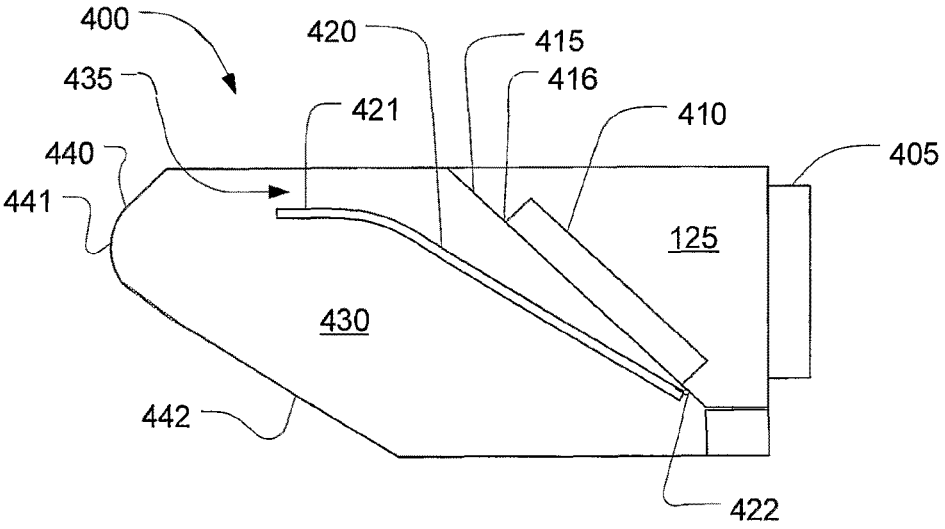
FIG. 5 illustrates another embodiment of a low profile exhaust hood.

Referring now to FIG. 5, an eyebrow hood 400 is shown in cross-section. The hood 100 has a recess 430 defined by sidewalls 442 and a top 440 which covers up to a forward edge 441 thereof. A back of the recess 430 is defined by a forward filter support plate 415 with openings 416 to permit the flow of exhaust effluent into a plenum 425 and supports (the supports are not shown) to support filter cartridges 410 in the openings 416. A baffle plate 420 is connected to the filter support plate 415 by a hinge 422. The hinge 422 allows the baffle plate 420 to be dropped down to the position indicated at 422 to allow the filter cartridges 416 to be removed and installed.

A grease trough 470 collects grease from the filter cartridges 410. The angle of the baffle plate 420 with respect to the filter support plate 415 defines a flow transition 435 leading to the faces of the filter cartridges 410. The position of the baffle plate 420 also defines a slot 435 through which the effluent stream is drawn by an exhaust system (not shown) connected to the plenum 425 by an exhaust collar 405. The baffle plate 420 also defines a sloping rear planar boundary of the recess 430. In the present embodiment, the slot 435 is extended by en extended portion 421, which in this case is horizontal. The baffle plate 420 may also, in an alternative configuration, be flat but inclined at an angle less than that shown in FIG. 1 to extend the slot 435.

Figure 6:
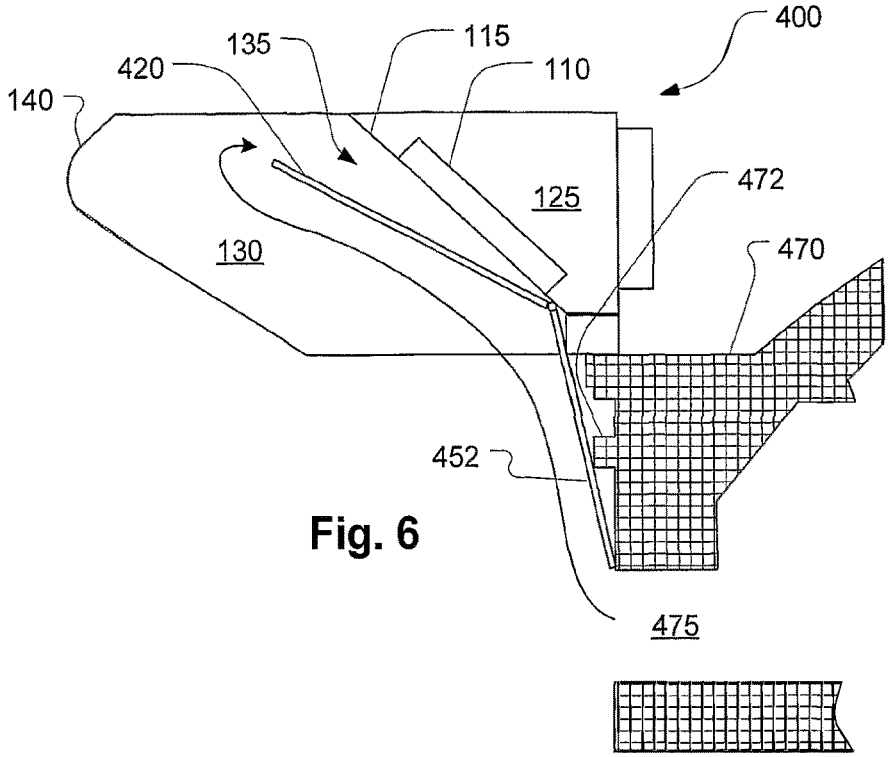
FIG. 6 illustrates a flow transition feature that may be used for applications of the foregoing embodiments.

Referring now to FIG. 6, an eyebrow hood 400 protects an oven 470 such as a pizza oven. A mouth of the oven 475 is well below the eyebrow hood 400 proper. A baffle extension plate 452 bridges a gap between the mouth 475 and a baffle plate 420. In other respects, the configuration of FIG. 5 is like that of FIGS. 1 and 2. The presence of the baffle extension plate 452 provides for a smooth wall-transition to which thermal plumes may attach and rise toward the slot 135 without the turbulence-inducing effect of abrupt edges, for example as indicated at 472, as might otherwise be present in the Coanda flow path.

Figure 7:
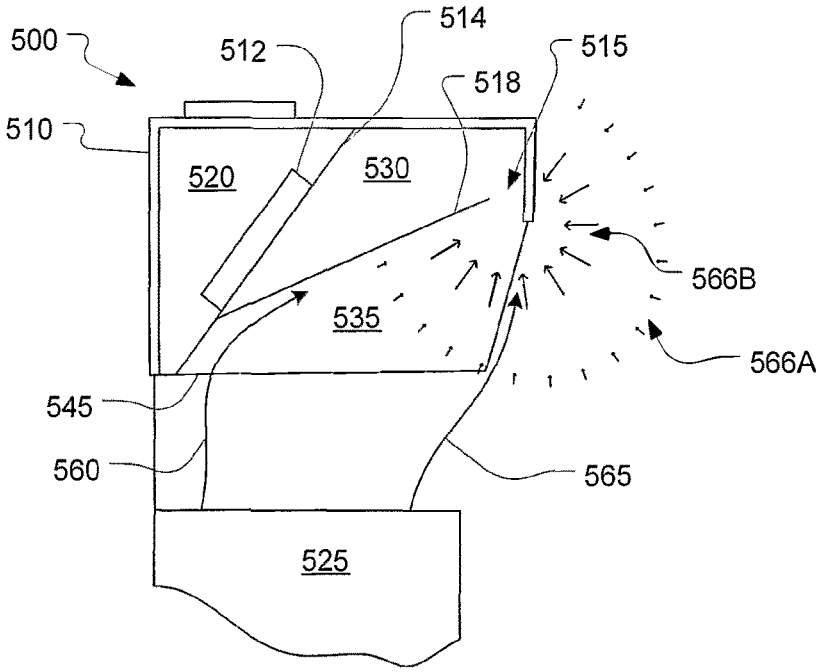
FIG. 7 illustrates a backshelf hood embodiment.

Referring now to FIG. 7, the principles behind the eyebrow hood of the foregoing figures can be extended to backshelf hoods such as indicated at 500. A canopy portion 510 extends over a cooking process 525 defining, in cooperation with a baffle plate 518 and filter support plate 514, a plenum 520, a manifold 530, and a recess 535. An inlet slot 515 draws fumes from the cooking process 525 from a forward part of the recess 535 creating a suction zone near the front of the hood 500 which is indicated by arrays of arrows 566A and 566B. Side skirts 545 may protect the ends of the hood, in the dimension going into and out of the drawing plane.

As in the eyebrow hood of FIGS. 1 and 2, the baffle plate 518 provides a surface to which thermal plumes, as indicated at 560, may attach and rise toward the inlet slot 515. Plumes generated closer to the forward end of the hood 500, such as indicated at 565, rise in a plug flow that is independent of any surface, but proximate the suction zone 566A, 566B of the inlet slot 515. By locating the inlet to the exhaust close to the forward edge of the hood 500, a suction zone is created close to the forward edge which helps to prevent the escape of thermal plumes near the forward edge.

Figure 9:
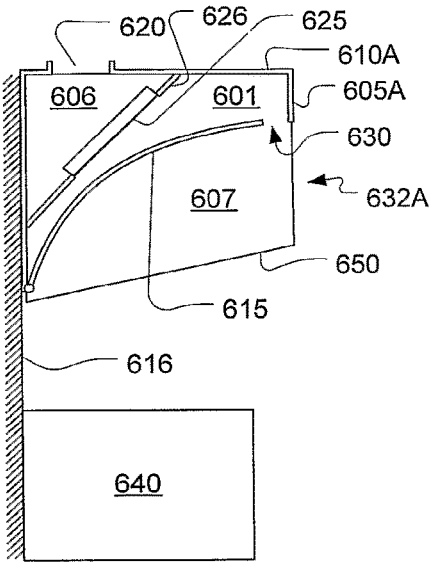
FIGS. 8-12 illustrate variations on the embodiment of FIG. 7.
Figure 8:
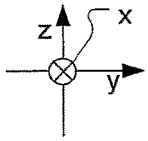

Referring to FIGS. 8 through 12, a common coordinate system with respect to the plane of the drawing page is illustrated in FIG. 8. In the normal reading position, the y-axis is left to right, the z-axis is up and down, and the x-axis goes into the drawing plane directly away from the reader. Referring now particularly to FIG. 9, a curved baffle plate 615 rises from a back wall plane 616 up to an inlet slot 630. A hood 610A defines, in conjunction with a filter support plate 626 and the baffle plate 615, a plenum 606, a header chamber 601, and a recess 607. An exhaust opening 620 connects the plenum 606 to an exhaust system (not shown). Side skirts 650 may also be provided. This embodiment differs from that of FIG. 7 in having a smoothly curving baffle plate 615 rather than a flat one and also in the precise matching of the baffle plate 615 surface and that of the back wall 616. Either of these features may be provided independent of the others. Note that a forward edge 605A of the hood 610A drops down only as far as the inlet slot 630. In this arrangement, the suction zone in front of the hood 610A is maximized. Also note that the forward access 632C is high due to an absence of the more typical deep recess of a conventional hood design.

Figure 10:
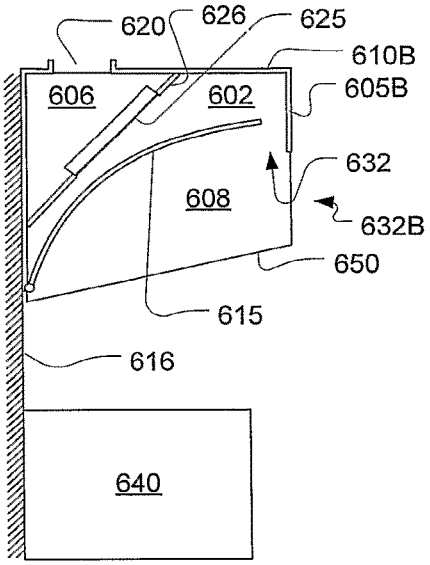

Referring now to FIG. 10, an embodiment similar to that of FIG. 9 is shown. The present embodiment has a more extended forward edge 605B of the hood 610B compared to the embodiment of FIG. 9. The extended edge 605B increases the capacity of a recess 608 compared to that of recess 607 of FIG. 9. The increased size of the recess allows a greater buffering effect and reduces the height forward access 632B. The lower height of the forward access increases mean velocity through the forward access region. The configuration of FIG. 10, with the increase recess volume may be more suited to lower temperature or lower moisture effluent sources to sources which produce more variable fume plumes in terms of the distribution along the x-axis or in terms of time.

Figure 11:
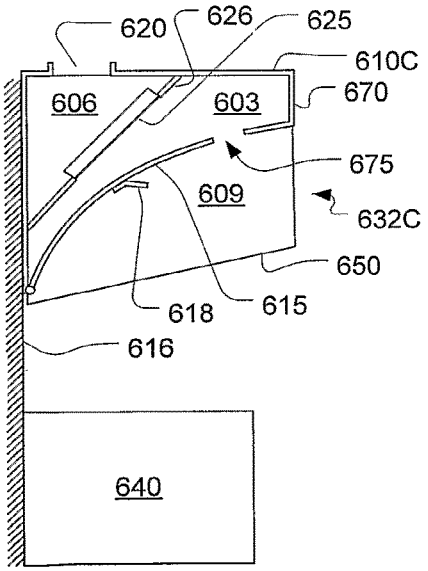

Referring now to FIG. 11, an embodiment similar to that of FIG. 10 is shown. In the present embodiment, the inlet slot 675 (formed between the baffle 615 and a portion of the front wall 670), although in a substantially forward position, is moved, compared to the previous to embodiment, toward the rear. This has the effect of focusing the suction zone downwardly and rendering it somewhat less diffuse. The more middle position may be used in combination with any of the foregoing features. It has been determined to be more suitable for applications where there are fewer external disturbances to disrupt the rising plumes from the cooking process 640.

Also illustrated in the present embodiment is a spoiler 618. The spoiler 618 spreads any Coanda plumes in the x-axis direction so that a fast moving pulsatile thermal plume is less likely to flow past the inlet slot 675. Essentially, it is a mechanism for transverse (x-direction) mixing of the z-*y-direction momentum that is tangent to the surface of the baffle 615 (or, put another way, the transverse mixing of the component of the flow along this surface's gradient). Paradimatically, a transient plume that is localized with respect to the x-axis may overwhelm the suction capacity of the inlet slot 675 at a particular point along x. If such a plume is spread across the x-axis by turbulent mixing, its locally high velocity may be reduced and the resulting wider (and slower) plume may be more easily handled by the suction of the inlet slot 675. The spoiler may be provided with or without other features and in combination with any of the foregoing features discussed in connection with this or the other embodiments to the same effect.

Figure 12:
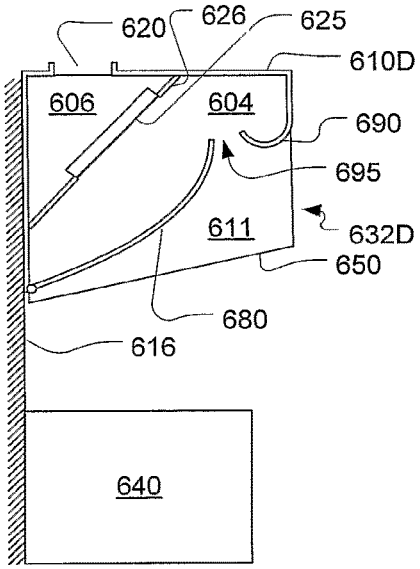
Figure 13A:
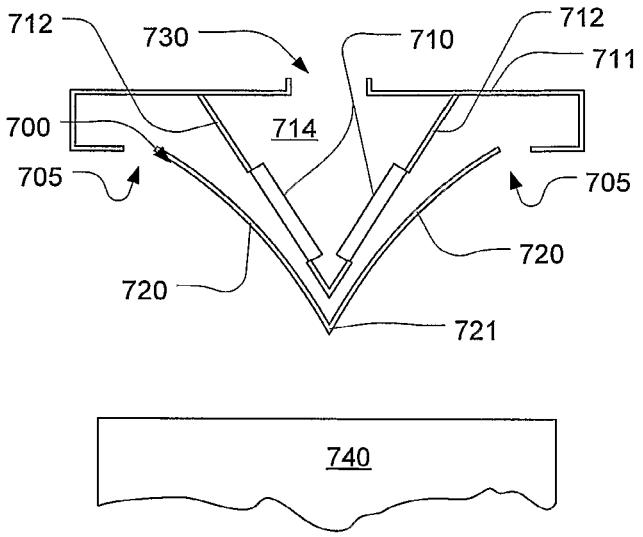
FIGS. 13A-13C illustrate a canopy hood embodiment.
Figure 13B:
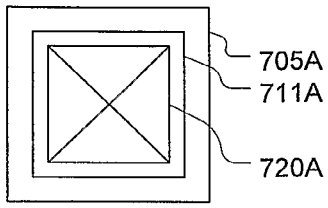
Figure 13C:
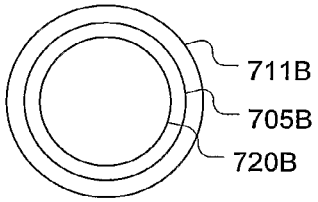

Referring to FIG. 12, an alternative to the use of a spoiler, such as spoiler 618 in FIG. 11, which may have a similar effect, is to make the attachment surface, that of the baffle plate 680, convex in shape. This reduces the volume of the recess 611 but it increases the resistance to plug flow formation and forces plumes to tend to spread across the surface of the baffle plate 680. In the present embodiment, the forward edge (i.e., front wall 690) of the hood 610D also curves toward the inlet slot 695.

Referring now to FIGS. 13A-13D, a canopy style hood 700 has an exhaust outlet 730 and an exhaust inlet slot 705 that surrounds the entire canopy 711. Flow guide plates 720 having the form of a pyramidoid or conoid structure run from a low point 721 up to the inlet slot 705. A filter support structure 712 supports filters 710 and defines a plenum 714 connecting flow through the filters 710 to the exhaust outlet 730. The flow guide plates may be provided with a door (not shown) to allow access to the filters 710.

Figure 14:
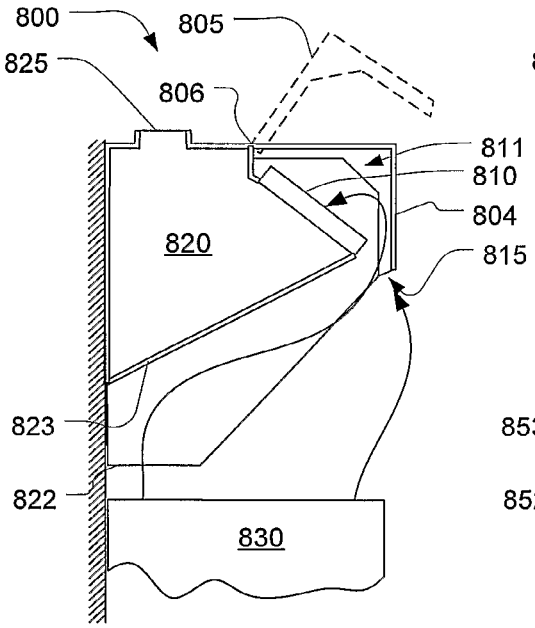
FIGS. 14 and 15 illustrate features associated with mounting a filter.
Figure 15:
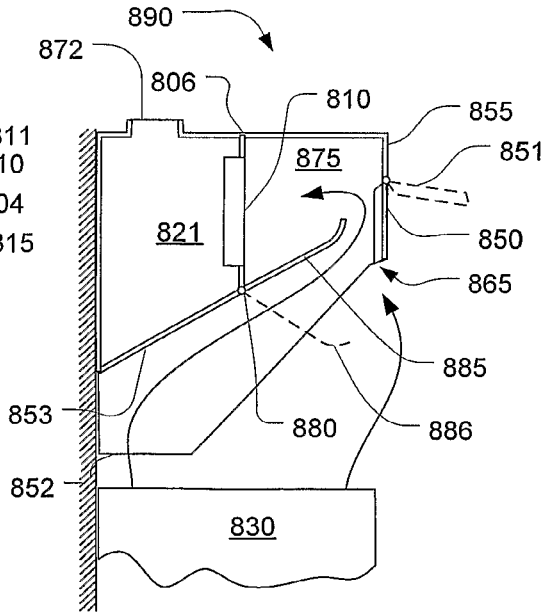

Referring now to FIGS. 14 and 15, some alternative ways of arranging a filter in combination with a forwardly located exhaust inlet while maintaining a compact configuration and a relatively narrow (and therefore, high velocity) intake, are illustrated. In a hood 800 of FIG. 14, a hatch, shown in a closed configuration at 804 and open at 805 provides access to a filter 810 mounted on a plenum 820. Fumes from an appliance 830 flow through an inlet 815 into a header space 811, through the filter 810, into plenum 820 and out through an exhaust outlet 825. As in previous embodiments, a sloping flow wall 823 runs from the rear toward the front and upwardly to allow fume plumes to attach. A side skirt 822 may be provided to mitigate end effects. In a hood 890 of FIG. 15, two hatches 850 and 885 are provided, the hatch 850 shown in a closed configuration at 850 and open at 851. The hatches 850 and 885 provide access to a filter 810 mounted on a plenum 821. Fumes from an appliance 830 flow through an inlet 865 into a header space 875, through the filter 810, into plenum 821 and out through an exhaust outlet 872. As in previous embodiments, a sloping flow wall 853 runs from the rear toward the front and upwardly to allow fume plumes to attach. A side skirt 852 may be provided to mitigate end effects.

Figure 16A:
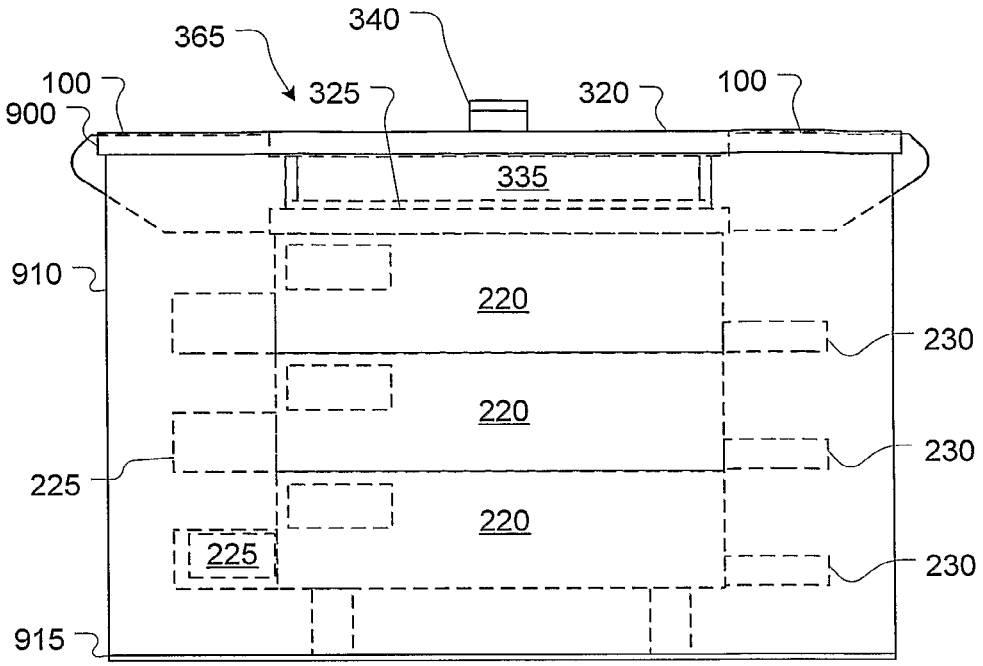
FIGS. 16A and 16B illustrate a retractable radiation and convection shield.
Figure 16B:
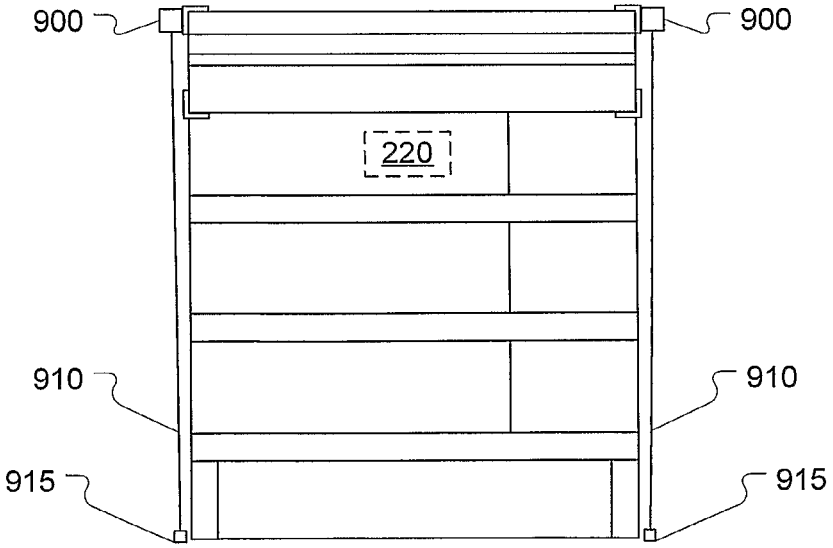

Referring to FIGS. 16A and 16B, a retractable curtain 910 of heat resistant reflective material is drawn from a spool 900 down to cover the sides of stack of ovens 220. The configuration is not unlike that of a home movie screen, permitting the curtain 910 to be easily retracted out of the way. A weighted bar 915 keeps the bottom of the curtain in place. Alternatively, a curtain (not shown) may be made of rigid material and placed in a similar position. Also, the curtain 910 need not be drawn all the way down. The curtain 910 reduces the air flow required for containment and capture by acting as a convection-inhibiting side curtain. It also increases comfort by reducing radiation to the surrounding space. Finally, the curtain 910 also reduce heat loss of the oven so the oven's energy consumption is reduced. Variations of the curtain may be provided to achieve these benefits. For example, rigid panels (not shown) that pivot on a vertical axis may be mounted to swing over the sides of the hoods 100 without covering the oven 220 sides.

It will be observed that various features have been described in connection with the foregoing embodiments. These features may be combined in combination and various subcombinations. As can be seen in FIGS. 1 to 3, the exhaust inlet is located as high as possible in a low profile hood 1005 by employing the baffle plate 120 as illustrated. The inlet 135 is defined between the top of the hood 143 and the edge of the baffle. As may be seen in other embodiments, the baffle may have an opening while still providing a high location for the inlet.

Figure 17:
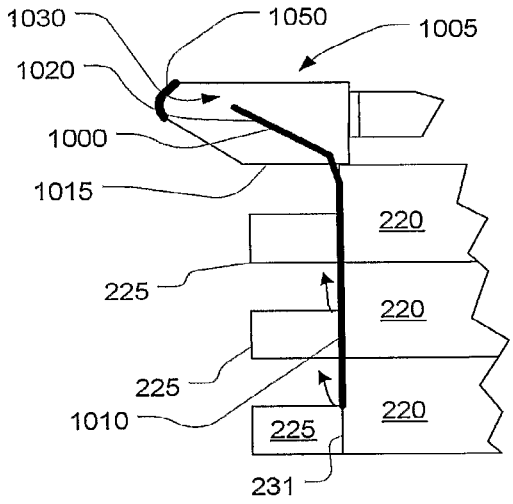
FIG. 17 illustrates features of the inventive embodiments.

As shown in FIG. 17, the baffle 120 (and similarly for the other embodiments) also is aligned to form a substantially continuous wall surface 1000 (shown by the heavy line which is superimposed on the oven/hood combination) extending from the face of the oven 1010 to the baffle portion 1120 leading up to the inlet 1030. Because the ovens 220 are hot and because fumes escaping from them are hot, they tend to rise aggressively along the surface and also due to the wall-flow (Coanda flow) effect, this continuous surface helps to guide much of the fumes directly to the inlet 1030. At the same time, the inlet 1030 is located remotely from the oven to create a suction zone positioned to capture rising fumes that are deflected away from the surface 1000 by ambient gusts or by food items on the conveyor shelves 225. Still further, a lip 1050 is defined to create a small buffer volume between the inlet and the lip 1050 of the hood 1005 to help ensure containment when fume loads are irregular.

Still another feature of the FIG. 17 design and other embodiments is the low profile of the hood 1005, which in preferred embodiments, is wider than it is high. This is advantageous because the overhead clearance for such ovens as 220 may be limited. Also, the side skirts 1015 are taller close to the ovens 220 but narrow toward the lip 1050 to provide greater clearance for workers needing to stand close to the ovens 220 to access the loading and/or unloading trays 225.

The above features may be employed in subcombinations. For example, the continuous wall 1000 may be provided in other configurations, for example, with an inlet located lower than the top of the hood 1005 or without side skirts 1015 or lip 1050. For another example, the low aspect-ratio hood design may have more conventional structures such as ones that do not provide the continuous surface 1000; i.e., baffle 120 (FIG. 1) 1020 removed.

What is claimed is:

1. An exhaust hood, comprising:

a top wall extending in a horizontal direction;

a front wall having a first end and a free end, the front wall extending in a vertical direction from the first end at a front edge of the top wall to the free end remote from the top wall;

a filter support plate arranged under the top wall in the vertical direction and spaced from the front wall in the horizontal direction, the filter support plate being angled such that a bottom edge of the filter support plate remote from the top wall is farther in the horizontal direction from the front wall than a top edge of the filter support panel proximal to the top wall, the filter support plate being constructed to retain a grease filter therein; and a baffle plate including a convex curvature arranged below the filter support plate in the vertical direction, wherein surfaces of the top wall, the front wall, the filter support plate, and a surface of the baffle plate bound a chamber through which fumes flow to the grease filter retained by the filter support plate, and the front wall is convexly curved along a portion proximal to the free end such that the free end is closer to the filter support plate in the horizontal direction than the front edge of the top wall.

2. The exhaust hood of claim 1, wherein, in the vertical direction, the free end of the front wall is closer to the top wall than a portion of the front wall between the first end and the free end.

3. The exhaust hood of claim 1, wherein, in the vertical direction, the free end of the front wall is below a top end of the grease filter retained by the filter support plate.

4. The exhaust hood of claim 1, wherein the top edge of the filter support plate abuts the top wall, the free end of the front wall being below the top edge of the filter support plate in the vertical direction.

5. The exhaust hood of claim 1, wherein, in the vertical direction, the top wall is spaced from the free end such that at least a portion of the chamber through which fumes flow is formed between the top wall and the free end.

6. The exhaust hood of claim 5, wherein a bottom edge of the baffle plate is coplanar with the bottom edge of the filter support plate, and the baffle plate is at an angle with respect to the horizontal direction such that a top edge of the baffle plate is closer to both the top wall and the front wall than the baffle plate bottom edge.

7. The exhaust hood of claim 6, wherein the free end of the front wall and the top edge of the baffle plate define an inlet to said chamber.

8. The exhaust hood according to claim 1, wherein the baffle plate is convexly curved continuously along the entire length of the baffle plate.

9. The exhaust hood according to claim 1, wherein the baffle plate includes a hinged connection at one end.

* * * * *